US011313542B1

(12) United States Patent
Zhu

(10) Patent No.: US 11,313,542 B1
(45) Date of Patent: Apr. 26, 2022

(54) FOLDABLE LED LIGHT

(71) Applicant: Shenzhen Chinaunion Technology Co., Ltd., Shenzhen (CN)

(72) Inventor: Xueping Zhu, Chenzhou (CN)

( * ) Notice: Subject to any disclaimer, the term of this patent is extended or adjusted under 35 U.S.C. 154(b) by 0 days.

(21) Appl. No.: 17/452,043

(22) Filed: Oct. 22, 2021

(30) Foreign Application Priority Data

Sep. 30, 2021 (CN) ..... 202122385506.7

(51) Int. Cl.

| | |
|---|---|
| ***F21V 19/02*** | (2006.01) |
| ***F21V 17/10*** | (2006.01) |
| ***F21V 23/06*** | (2006.01) |
| ***F21Y 115/10*** | (2016.01) |

(52) U.S. Cl.
CPC ..... *F21V 19/02* (2013.01); *F21V 17/10* (2013.01); *F21V 23/06* (2013.01); *F21Y 2115/10* (2016.08)

(58) Field of Classification Search
CPC ..... F21V 19/02; F21V 17/10; F21V 21/26; F21V 23/06; F21Y 2115/10; F21Y 2103/10; F21S 4/20; F21S 4/28
See application file for complete search history.

(56) References Cited

U.S. PATENT DOCUMENTS

| | | | | |
|---|---|---|---|---|
| 7,896,568 | B2 * | 3/2011 | Atkinson | F21V 27/00 403/62 |
| 7,918,585 | B2 | 4/2011 | Tucker | |
| 8,371,894 | B1 * | 2/2013 | Rosen | A63H 33/108 446/91 |
| 8,858,044 | B2 | 10/2014 | Tang et al. | |
| 10,215,379 | B2 * | 2/2019 | Dix | F21V 21/28 |
| 10,907,785 | B2 * | 2/2021 | Shine | F21S 4/28 |
| 2011/0140640 | A1 * | 6/2011 | Lu | F21V 17/007 315/362 |
| 2013/0141914 | A1 * | 6/2013 | Lai | F21V 21/22 362/249.03 |

* cited by examiner

*Primary Examiner* — Peggy A Neils
(74) *Attorney, Agent, or Firm* — W&KIP

(57) ABSTRACT

The present disclosure discloses a foldable LED light, comprising: a mounting base and a first mounting plate rotatably provided in the mounting base, wherein, the first mounting plate is provided with two mounting holes at an end away from the mounting base, the mounting holes are rotatably provided with a second mounting plate, wherein, the second mounting plate is fixedly provided with a plug-in shaft at an end, the plug-in shaft is inserted into the mounting hole, the plug-in shaft is a cavity structure with openings at both ends, the plug-in shaft is provided with a plurality of openings in a side wall, and a bump is fixedly provided on outside of the plug-in shaft, the plug-in shaft is plugged with a column at an upper end.

7 Claims, 4 Drawing Sheets

FOLDABLE LED LIGHT

CROSS-REFERENCE TO RELATED APPLICATIONS

This is a U.S. patent application which claims the priority and benefit of Chinese patent application number 202122385506.7, filed on Sep. 30, 2021, the disclosure of which is incorporated herein by reference in its entirety.

TECHNICAL FIELD

The disclosure relates to the field of foldable light. Specifically, the disclosure relates to a foldable LED light.

BACKGROUND

Lights as a kind of lighting apparatus are widely used in life. There are various forms of lights, and foldable lights as a kind of lights have a lot of benefits in use, such as reducing the volume and saving packing materials when packing after manufacturing and producing, and saving space when storing. However, the existing foldable lights use a large number of bolts, which is very tedious when assembling. Moreover, the existing foldable lights can only achieve one-level folding, and when the area to be illuminated is relatively large, the lighting effect in one-level folding cannot meet the requirements.

SUMMARY

The present disclosure aims to provide a foldable LED light to solve the problems presented in above.

To achieve the above purpose, the disclosure provides a foldable LED light, comprising a mounting base and a first mounting plate rotatably provided in the mounting base, wherein, the first mounting plate is provided with two mounting holes at an end away from the mounting base, the mounting holes are rotatably provided with a second mounting plate.

The second mounting plate is fixedly provided with a plug-in shaft at an end, the plug-in shaft is inserted into the mounting hole, the plug-in shaft is a cavity structure with openings at both ends, the plug-in shaft is provided with a plurality of openings in the side wall, and a bump is fixedly provided on the outside of the plug-in shaft, the plug-in shaft is plugged with a column at the upper end.

The first mounting plate and the second mounting plate have LED light panels mounted therein.

Preferably, the first mounting plate and the second mounting plate are provided with a placement slot in the upper part, the LED light panel is mounted inside the placement slot, and a cover plate is mounted on the top of the placement slot.

Preferably, a recess is provided in the side wall of the placement slot, and an embossing is provided on the outside of the cover plate to match with the recess.

Preferably, the mounting holes are provided with stoppers on the outside.

Preferably, the first mounting plate is fixedly mounted with a plug-in plate on a side in contact with the mounting base.

The mounting base is provided with a recess in the upper part, a clamping block is fixedly mounted in the recess, and a gap is provided between the clamping block and the side wall of the recess for mounting the plug-in plate.

The plug-in plate is provided with outwardly raised cylinder on the outside, and a U-shaped slot matching the cylinder is provided in the clamping block.

Preferably, an outside end surface of the cylinder is obliquely set.

Preferably, the second mounting plate is provided with a fixing block at an end away from the mounting hole, and the first mounting plate is provided with a fixing slot matching the fixing block at the bottom.

Compared with the prior art, the disclosure can at least achieve the following beneficial effect.

By setting the first mounting plate and the second mounting plate, the disclosure can achieve two-level folding. When the light demand is relatively large, the foldable LED light is unfold in two-level; and when the light demand is not large, the foldable LED light is unfold in one-level, which is convenient. And by providing the plug-in plate, cylinder, plug-in shaft and mounting hole and so on, it avoids to use of bolts, and when assembling, only a simple clamping can assemble the light, which is convenient.

The present disclosure discloses a foldable LED light, comprising: a mounting base and a first mounting plate rotatably provided in the mounting base, wherein, the first mounting plate is provided with two mounting holes at an end away from the mounting base, the mounting holes are rotatably provided with a second mounting plate, wherein, the second mounting plate is fixedly provided with a plug-in shaft at an end, the plug-in shaft is inserted into the mounting hole, the plug-in shaft is a cavity structure with openings at both ends, the plug-in shaft is provided with a plurality of openings in a side wall, and a bump is fixedly provided on outside of the plug-in shaft, the plug-in shaft is plugged with a column at an upper end. By setting the first mounting plate and the second mounting plate, the disclosure can achieve two-level folding. When the light demand is relatively large, the foldable LED light is unfold in two-level; and when the light demand is not large, the foldable LED light is unfold in one-level, which is convenient. And by providing the plug-in plate, cylinder, plug-in shaft and mounting hole and so on, it avoids to use of bolts, and when assembling, only a simple clamping can assemble the light, which is convenient.

BRIEF DESCRIPTION OF THE DRAWINGS

In order to more clearly describe the technical solution in the embodiments of the present disclosure, the following will briefly introduce the drawings that need to be used in the description of the embodiments of the present disclosure.

In the figure: 1. mounting base; 11. clamping block; 2. first mounting plate; 21. plug-in plate; 22. fixing slot; 3. cover plate; 4. column; 5. mounting hole; 51. stopper; 6. placement slot; 7. second mounting plate; 71. plug-in shaft; 72. fixing block.

DETAILED DESCRIPTION

The following will be a clear and complete description of the technical solutions in the embodiments of disclosure in conjunction with the accompanying drawings in the embodiments of disclosure. Obviously, the described embodiments are only a part of the embodiments of disclosure. Based on the embodiments in the disclosure, all other embodiments obtained by a person of ordinary skill in the art without making creative work fall within the scope of protection of the disclosure.

Referring to FIGS. 1-4, this embodiment provides a foldable LED light comprising a mounting base 1 and a first mounting plate 2 provided in the mounting base 1. The first mounting plate 2 can be mounted directly on the mounting base 1 by a pivot, and the first mounting plate 2 can be rotated around the pivot so that the angle between the mounting bases 1 can be changed to achieve folding of the first mounting plate 2 and the mounting base 1.

Figure 1:
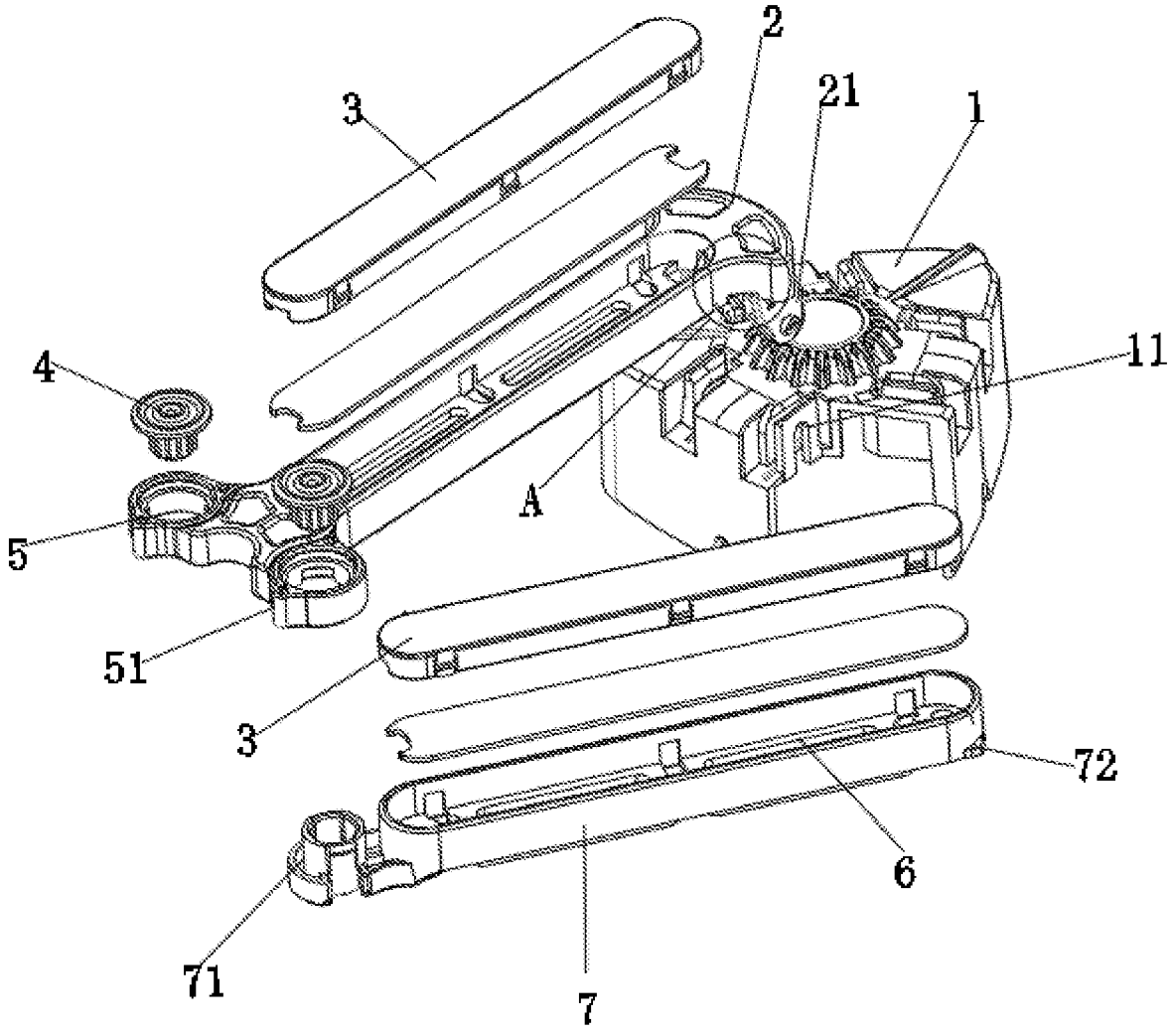
FIG. 1 is a schematic diagram of an exploded structure of the present disclosure.
Figure 2:
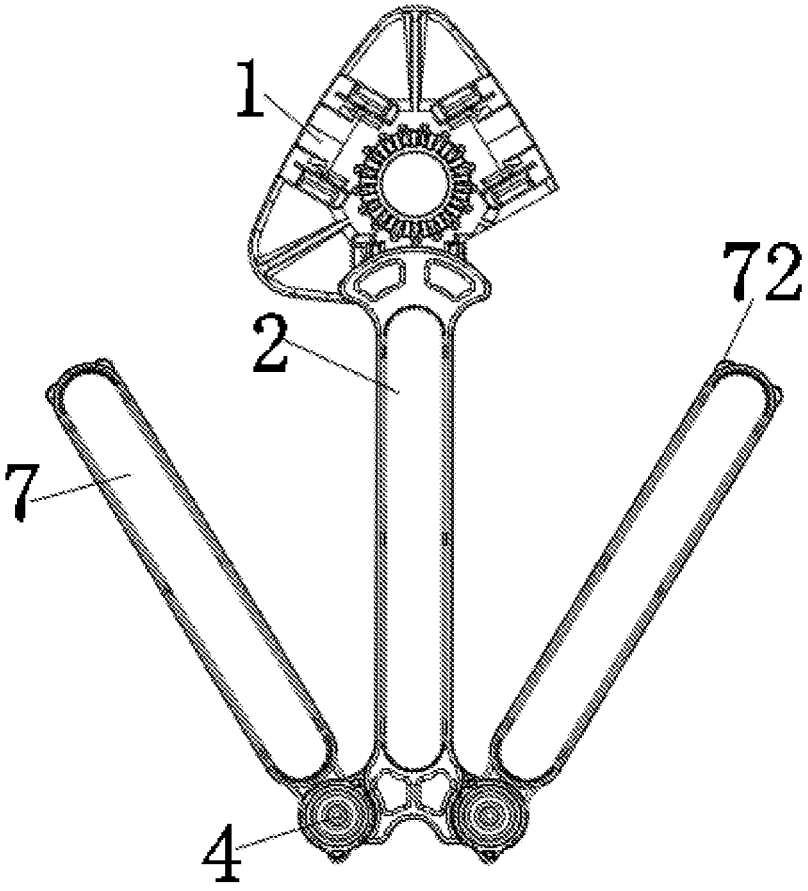
FIG. 2 is a schematic diagram of an unfolded structure of the disclosure.
Figure 3:
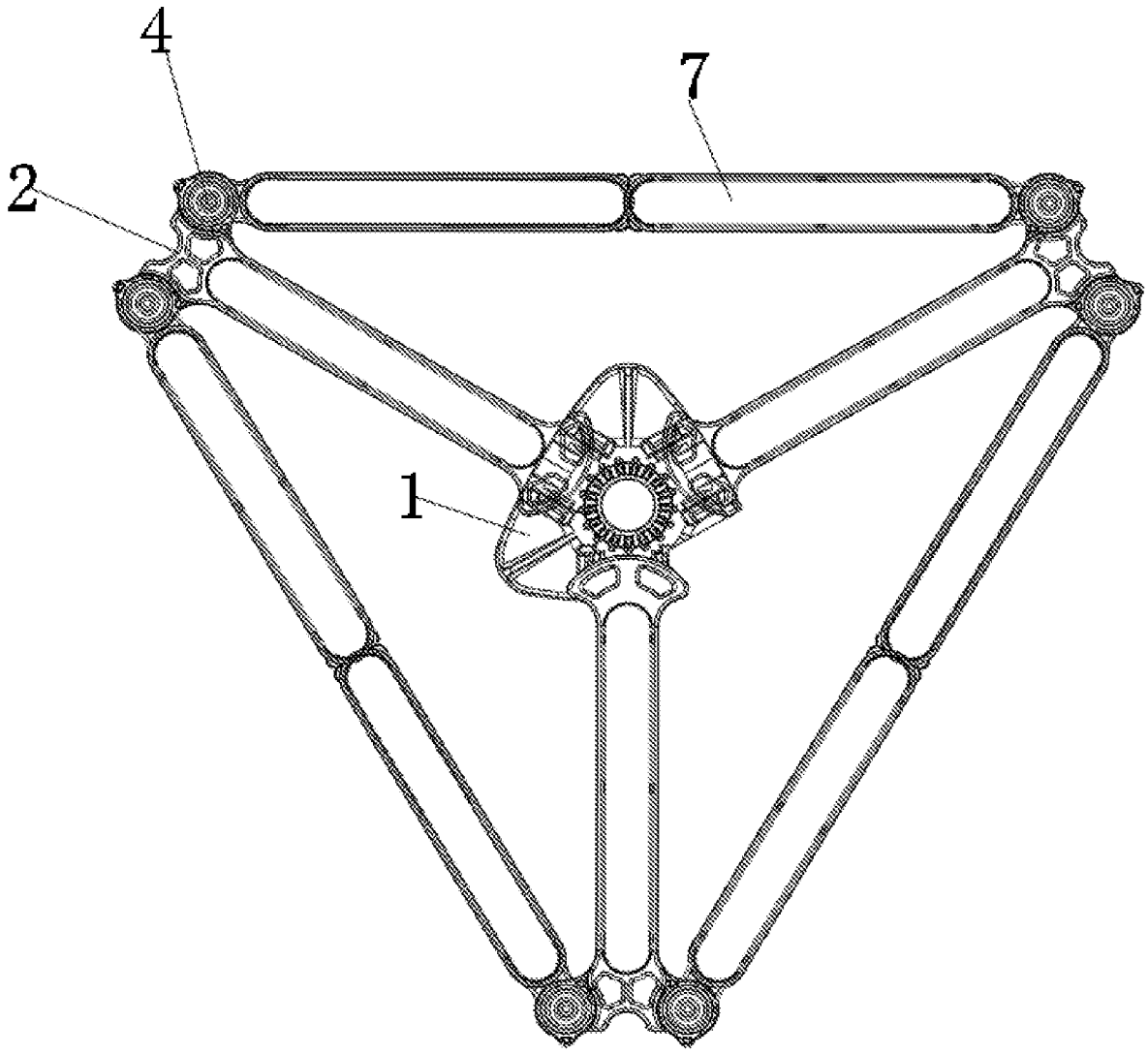
FIG. 3 is a schematic diagram of a fully unfolded structure of the disclosure.
Figure 4:
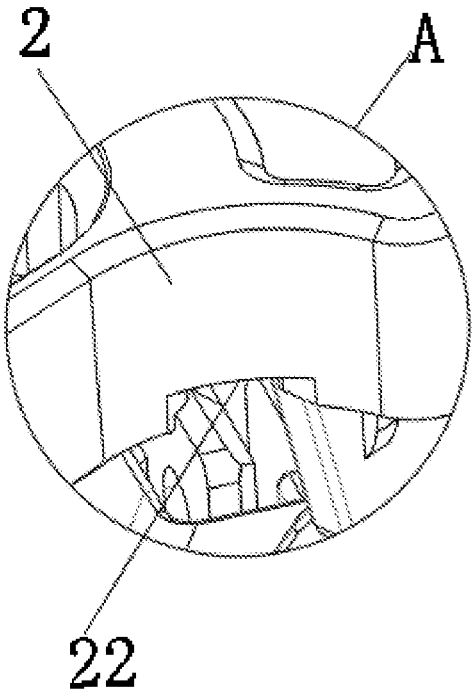
FIG. 4 is an enlarged view of A in FIG. 1 of the disclosure.

The first mounting plate 2 can also be connected to the mounting base 1 in other ways. As shown in FIG. 1, the first mounting plate 2 has a plug-in plate 21 fixedly mounted on a side in contact with the mounting base 1.

The upper part of the mounting base 1 is provided with a recess, and a clamping block 11 is fixedly mounted in the recess, and a gap between the clamping block 11 and the side wall of the recess is used to mount the plug-in plate 21; the plug-in plate 21 can be directly inserted into the inside of the gap.

The outside of the plug-in plate 21 is provided with an outwardly raised cylinder, and the clamping block 11 is provided with a U-shaped slot matching the cylinder. When inserting the plug-in plate 21 into the inside of the gap, with the support of the cylinder, the clamping block 11 will be tilted to the outside, and the cylinder can then be directly clamped into the inside of the U-shaped slot, and the plug-in plate 21 can be installed, avoiding the use of bolts, which is simpler and more convenient than the existing way of using the pivot as well as bolts.

In this embodiment, in order to facilitate the insertion between the plug-in plate 21 and the gap, the outside end surface of the cylinder is obliquely set, and during installation, the obliqued part can be inserted into the gap first, thereby facilitating the subsequent insertion of the plug-in plate.

As shown in FIG. 1, two mounting holes 5 are provided at an end of the first mounting plate 2 away from the mounting base 1. An end of the second mounting plate 7 is fixedly provided with a plug-in shaft 71, the plug-in shaft 71 is inserted into the mounting hole 5 and can be rotated in the mounting hole 5. The plug-in shaft 71 is a cavity structure with openings at both ends, the side wall of the plug-in shaft 71 is provided with four openings. The four openings divide the plug-in shaft 71 into four parts, two of which are symmetrical and fixedly provided with a bump, and the upper end of the bump is provided with an outwardly inclined structure to facilitate insertion of the plug-in shaft into the interior of the mounting hole 5. The upper end of the plug-in shaft 71 is plugged with a column 4; the column 4 is plugged into the interior of the plug-in shaft 71 to support the plug-in shaft 71 and to avoid the second mounting plate 7 falling off due to the inward movement of the side wall of the plug-in shaft 71.

In a further embodiment, as shown in FIG. 1, the outside of the mounting hole 5 is provided with a stopper 51, which acts as a limit to the second mounting plate 7, enabling the second mounting plate to be rotated within a range of 0-150 degrees.

Both the first mounting plate 2 and the second mounting plate 7 are provided with a placement slot 6 in the upper part, and the LED light panel is installed inside the placement slot 6, and a cover plate 3 is installed on the top of the placement slot 6 and the LED light panel is provided with a gap at an end, and the gap is used to place a wire for power supply with the LED light panel. Setting the wires on the inside of the mounting plate avoids exposed wires and makes it safer to use.

The cover plate 3 may be mounted to the mounting plate by bolts. In this embodiment, a clamping placement connection can also be used. A recess is provided in the side wall of the placement slot 6, and the outside of the cover plate 3 is provided with an embossing that clamps into the recess. After the LED light panel is installed, the cover plate 3 is then pressed and the embossing is pressed into the recess to complete the clamping connection between the cover plate 3 and the mounting plate.

In a further embodiment, the second mounting plate 7 is provided with a fixing block 72 at an end away from the mounting hole 5, and the first mounting plate 2 is provided with a fixing slot 22 matching the fixing block 72 at the bottom. When the second mounting plate 7 is folded, the fixing block 72 is clamped to the inside of the fixing slot 22, and the fixing of the second mounting plate 7 can then be achieved. The second mounting plate 7 will not rotate to the outside without external force.

Although embodiments of the disclosure have been shown and described, it will be understood to one of ordinary skill in the art that a variety of variations, modifications, replacements and variants of these embodiments can be made without departing from the principles and spirit of the disclosure, the scope of which is limited by the appended claims and their equivalents.

What is claimed is:

1. A foldable LED light, comprising:

a mounting base and a first mounting plate rotatably provided in the mounting base, wherein, the first mounting plate is provided with two mounting holes at an end away from the mounting base, the mounting holes are rotatably provided with a second mounting plate, wherein, the second mounting plate is fixedly provided with a plug-in shaft at an end, the plug-in shaft is inserted into the mounting hole, the plug-in shaft is a cavity structure with openings at both ends, the plug-in shaft is provided with a plurality of openings in a side wall, and a bump is fixedly provided on outside of the plug-in shaft, the plug-in shaft is plugged with a column at an upper end, and wherein, the first mounting plate and the second mounting plate have LED light panels mounted therein.

2. The foldable LED light according to claim 1, wherein, the first mounting plate and the second mounting plate are provided with a placement slot in an upper part, a LED light panel is mounted inside the placement slot, and a cover plate is mounted on top of the placement slot.

3. The foldable LED light according to claim 2, wherein, a recess is provided in a side wall of the placement slot, and an embossing is provided on outside of the cover plate to match with the recess.

4. The foldable LED light according to claim 1, wherein, the mounting holes are provided with stoppers on outside.

5. The foldable LED light according to claim 4, wherein, the first mounting plate is fixedly mounted with a plug-in plate on a side in contact with the mounting base, wherein, the mounting base is provided with a recess in an upper part, a clamping block is fixedly mounted in the recess, and a gap is provided between the clamping block and a side wall of the recess for mounting the plug-in plate, and wherein, the plug-in plate is provided with outwardly raised cylinder on outside, and a U-shaped slot matching the cylinder is provided in the clamping block.

6. The foldable LED light according to claim 5, wherein, an outside end surface of the cylinder is obliquely set.

7. The foldable LED light according to claim 5, wherein, the second mounting plate is provided with a fixing block at an end away from the mounting hole, and the first mounting plate is provided with a fixing slot matching the fixing block at bottom.

* * * * *